US010667066B2

(12) United States Patent
Beyfuss et al.

(10) Patent No.: US 10,667,066 B2
(45) Date of Patent: May 26, 2020

(54) HEARING AID AND KIT FOR A HEARING AID

(71) Applicant: SIVANTOS PTE. LTD., Singapore (SG)

(72) Inventors: Stefanie Beyfuss, Erlangen (DE); Kok Chian Hong, Singapore (SG); Bjoern Freels, Erlangen (DE); Anand Ganapathy, Singapore (SG); Kim Hock Kwok, Singapore (SG); Fu Keon Ho, Singapore (SG); Holger Kral, Fuerth (DE); Zainal Abidin Bin Mohd Yahya, Singapore (SG); Yi Ren Chris Tan, Singapore (SG); Frank Naumann, Bubenreuth (DE); Christian Lindschou Hansen, Vedbaek (DK); Lau Malthe Borch, Copenhagen (DK)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/214,850

(22) Filed: Dec. 10, 2018

(65) Prior Publication Data

US 2019/0110141 A1 Apr. 11, 2019

Related U.S. Application Data

(63) Continuation of application No. PCT/EP2017/064190, filed on Jun. 9, 2017.

(30) Foreign Application Priority Data

Jun. 10, 2016 (DE) ..... 10 2016 210 338

(51) Int. Cl.
*H04R 25/00* (2006.01)

(52) U.S. Cl.
CPC ..... *H04R 25/602* (2013.01); *H04R 25/65* (2013.01); *H04R 2225/31* (2013.01); *H04R 2420/09* (2013.01)

(58) Field of Classification Search
CPC ..... H04R 25/02; H04R 25/60; H04R 25/654; H04R 2255/31
See application file for complete search history.

(56) References Cited

U.S. PATENT DOCUMENTS

| | | | |
|---|---|---|---|
| 6,731,770 | B1 | 5/2004 | Vonlanthen |
| 2002/0191806 | A1 | 12/2002 | Rohrseitz et al. |

(Continued)

FOREIGN PATENT DOCUMENTS

| | | | |
|---|---|---|---|
| DE | 102010041838 | A1 | 4/2012 |
| EP | 1246504 | A2 | 10/2002 |
| WO | 0079836 | A1 | 12/2000 |

*Primary Examiner* — Sunita Joshi
(74) *Attorney, Agent, or Firm* — Laurence A. Greenberg; Werner H. Stemer; Ralph E. Locher

(57) ABSTRACT

A hearing device contains an electronic frame for holding electronic components. The hearing device has first and second resilient contacts. The resilient contacts are fastened to the electronic frame, and the resilient contacts reversibly electrically contact an electronic component using contact surfaces of a double-pole battery. The hearing device contains a rechargeable battery module that contains a rechargeable battery and an electronic convertor. The rechargeable battery module is connected in an articulated manner to the electronic frame so as to be able to move and contains connecting contacts that correspond to the resilient contacts. A kit is provided for the hearing device and the kit has a battery compartment door for reversibly holding the double-pole battery. The battery compartment door is connected to pivot on the electronic frame such that as the battery compartment door is pivoted into a closed position the contact surfaces of the double-pole battery are contacted.

11 Claims, 4 Drawing Sheets

(56) References Cited

U.S. PATENT DOCUMENTS

| | | | | |
|---|---|---|---|---|
| 2006/0159298 | A1* | 7/2006 | von Dombrowski .. | H04R 25/48<br>381/330 |
| 2009/0067652 | A1* | 3/2009 | Schmidt ..... | H04R 25/556<br>381/314 |
| 2011/0058697 | A1* | 3/2011 | Shennib ..... | H04R 25/02<br>381/314 |

* cited by examiner

HEARING AID AND KIT FOR A HEARING AID

CROSS-REFERENCE TO RELATED APPLICATION

This is a continuation application, under 35 U.S.C. § 120, of copending international application No. PCT/EP2017/064190, filed Jun. 9, 2017, which designated the United States; this application also claims the priority, under 35 U.S.C. § 119, of German patent application No. DE 10 2016 210 338.5, filed Jun. 10, 2016; the prior applications are herewith incorporated by reference in their entirety.

BACKGROUND OF THE INVENTION

Field of the Invention

The invention relates to a hearing device, in particular a hearing aid. Furthermore, the invention relates to a kit for such a hearing device.

The term "hearing device" here and below in particular includes devices that are used to aid people who have impaired hearing abilities (hearing devices for this purpose are usually referred to as hearing aids), devices that are used for the purpose of tinnitus therapy (so-called tinnitus maskers) or devices for (tele-) communication (by way of example as a "headset"). In particular, hearing aids typically contain at least one microphone for ascertaining noises in the area surrounding a wearer of a hearing device. Furthermore, hearing aids usually contain a signal processing unit that is also referred to as a signal processor by which the ascertained noises are filtered, in part amplified and/or damped, and also where appropriate otherwise adjusted to the hearing impairment of the wearer of the hearing device. The noises that are processed in this manner are output to the ear of the wearer of the hearing device by a loudspeaker that is also referred to as an "earpiece". As an alternative to the loudspeaker, devices for mechanically or electrically stimulating the hearing of the wearer of the hearing device (by way of example a cochlear implant) may be used.

Typically, non-rechargeable batteries, in particular "button cell" batteries, preferably in a zinc-air configuration are used to supply energy to the above described (electronic) components of a hearing device. Alternatively, in particular in expensive hearing devices, rechargeable energy sources (also referred to as rechargeable batteries) are also used.

SUMMARY OF THE INVENTION

The object of the invention is to simplify the production of hearing devices having different energy supply systems.

The hearing device in accordance with the invention contains an electronic frame for holding electronic components (such as for example at least one microphone, a loudspeaker and also a signal processor for processing the noises that are ascertained by the at least one microphone). Furthermore, the hearing device contains a first resilient contact and a second resilient contact. Both the first as well as the second resilient contact are in this case fastened to the electronic frame and preferably electrically connected to at least one of the electronic components. In this case, the two resilient contacts are configured with and provided with contact surfaces of a double-pole battery, the contact surfaces being in particular at a different electrical potential, so as to reversibly electrically contact at least one of the electronic components. Furthermore, the hearing device contains a "rechargeable battery module", in other words a unit that contains a rechargeable battery and also an electronic convertor system. In this case, the electronic convertor system is used in particular so as to adjust the battery voltage value, which is provided by the rechargeable battery, to an operating voltage value that is required to operate the electronic components. In the intended assembled state of the hearing device, the rechargeable battery module is connected in an articulated manner to the electronic frame so as to be able to move and the rechargeable battery contains in addition connecting contacts that correspond to the two resilient contacts.

It is preferred that the rechargeable battery module also contains an electronic charging system for controlling a charging procedure of the rechargeable battery. It is preferred that the electronic charging system in this case also contains an antenna (by way of example an induction coil) for wireless charging of the rechargeable battery.

The double-pole battery is preferably a button cell (also known as: button battery) that in particular is embodied as a non-rechargeable battery (also referred to as a primary cell) in the form of a zinc-air battery. Alternatively, in this case the double-pole battery may also be a rechargeable battery (also referred to as a secondary cell or rechargeable battery) of the same design.

The electronic frame is preferably formed by a (in particular three-dimensional) circuit board or contains such a circuit board or a planar circuit board. In the latter case, the two resilient contacts are preferably fastened to the circuit board and are consequently fastened indirectly to the electronic frame.

The two resilient contacts are held preferably on a (common) contact carrier so as to simplify the assembly procedure on the electronic frame. This contact carrier is fastened to the electronic frame and is preferably electrically connected to at least one of the electronic components.

The fundamental idea of the invention is to be able to adapt a hearing device that is configured so as to use a predetermined energy source, specifically either a rechargeable battery module or a button cell, in particular during production in a simple manner so as to use another energy source, in other words the button cell or the rechargeable battery module. As a consequence, in particular the assembly outlay and in particular inventory-keeping costs for the respective components of hearing device models that are configured for different energy sources are reduced. By means of the above-described embodiment of the hearing device, in particular by means of the rechargeable battery module that is configured so as to contact the two resilient contacts that are provided for a conventional "hearing device battery" (button cell), it is advantageously possible in a particularly simple manner during the production of the hearing device depending upon the requirement to fit the hearing device for operation using a button cell or using a rechargeable battery, in particular using the rechargeable battery module. In particular, it is particularly advantageous that a particularly high proportion of common parts is provided by the embodiment in accordance with the invention for producing hearing devices having different energy sources with the result that inventory-keeping costs for storing a plurality of different components and assemblies may be reduced. Furthermore, assembly procedures may be simplified, in particular automated in a simpler manner, since only one small variation of components exists.

In one expedient embodiment, the rechargeable battery module contains three connecting contacts that are referred to below as first, second and third connecting contact. The first connecting contact and the second connecting contact are spaced with respect to one another in this embodiment in such a manner that these two connecting contacts are contacted in the intended contacting state of the rechargeable battery module, in particular simultaneously, by the first resilient contact. In other words, the first and the second connecting contact are short circuited by means of the first resilient contact in the intended contacting state. In this case, the third connecting contact is accordingly contacted using the second resilient contact.

The intended contacting state between the rechargeable battery module and the two resilient contacts of the contact carrier is produced in accordance with the above-mentioned embodiment in particular by moving the rechargeable battery module in the direction of the electronic frame, in particular in the direction of the contact carrier that carries the two resilient contacts. As a consequence, it is possible to switch on and switch off the hearing device by contacting the rechargeable battery module using the two resilient contacts or by removing the rechargeable battery module from these resilient contacts, comparable to inserting (by way of example swiveling or sliding) a button cell into the hearing device.

In one preferred embodiment, the second connecting contact of the rechargeable battery module is embodied in this case as a so-called control contact. This control contact is used in particular for the purpose of transferring the rechargeable battery module, preferably its electronic convertor system, reversibly into an active state or operating state (in other words switching on or switching off). The rechargeable battery module is activated in this case in particular by the above-described interconnection ("short circuit") of the first connecting contact to the control contact. Consequently, in an advantageous manner it is also rendered possible that as the rechargeable battery module is removed from the two resilient contacts not only the hearing device, specifically its electronic components, are "switched off" but rather (in particular owing to removing the short circuit of the first connecting contact to the control contact) the electronic convertor system that is integrated into the rechargeable battery module is also switched off or at least transferred into a type of "stand by" mode or "sleep" mode. As a consequence, in particular it is rendered possible that even in the case of a switched off hearing device the electronic convertor system of the rechargeable battery module does not consume energy or only consumes energy to an insignificant extent.

In a further expedient embodiment, the two resilient contacts of the contact carrier preferably contain contact sites (in other words contact surfaces) that stand perpendicular with respect to one another. The two resilient contacts are therefore preferably configured for the purpose of contacting the button cell on one side on a planar face (end face) and on the other side on the peripheral surface (that is at another electrical potential). It is advantageously rendered possible by this embodiment of the resilient contacts when using the same resilient contacts to also be able to insert button cells that are of different thicknesses.

In order to produce a simple contacting arrangement of the rechargeable battery module using the resilient contacts of the above-mentioned embodiment, in one expedient embodiment the first connecting contact and the second connecting contact (or the control contact) contain respectively an allocated contact site, in particular a surface and in the intended contacting state the corresponding resilient contact of the contact carrier lies against said surface. These contact sites of the first and the second connecting contact (the control contact) lie in this case approximately in a common plane, in particular on a planar surface of the rechargeable battery module. The third connecting contact is in this case oriented in its allocated contact site transversely and in particular in the thickness direction of the rechargeable battery module offset with respect to the contact sites of the first and second connecting contact. By way of example, the rechargeable battery module contains an approximately cylindrical basic structure, wherein the contact sites of the first and second connecting contact are arranged on an end face and the contact site of the third connecting contact is arranged on the "outer surface" (in other words on a peripheral surface) of the rechargeable battery module.

In one preferred embodiment, the rechargeable battery module is connected in an articulated manner to the electronic frame or to a housing of the hearing device so as to be able to move, in other words by way of example may be displaced or in particular may be pivoted in the manner of a battery compartment door. It is particularly preferred that the rechargeable battery module in this case may be adjusted between an "operating position", in which the rechargeable battery module is contacted in the intended manner using the resilient contacts, and an "off position" in which the connecting contacts of the rechargeable battery module are removed from the resilient contacts and consequently the energy supply to the electronic components of the hearing device is interrupted. It is preferred in this case that in the off position the electronic convertor system of the rechargeable battery module is also deactivated (in other words is switched off or in the sleep mode).

The kit in accordance with the invention for a hearing device contains the hearing device of the above-described type. In other words, the kit contains the hearing device that in turn contains the electronic frame and also the two resilient contacts (where appropriate that are held on the contact carrier) of the above-mentioned type and also the above-described rechargeable battery module. Moreover, the kit also contains a battery compartment door for reversibly holding the button cell. In this case, this battery compartment door may be connected in an articulated manner in particular so as to be able to pivot on the electronic frame or on the housing of the hearing device (in other words is connected in an articulated manner in the intended assembled state) in such a manner that as the battery compartment door is pivoted into a closed position the contact surfaces of the button cell (that is inserted into the battery compartment door in the intended manner) are contacted using the two resilient contacts. The hearing device of the kit in accordance with the invention may consequently if necessary advantageously be selectively fitted with the above-described battery compartment door or the above-described rechargeable battery module, in particular depending upon the energy source that is to be used. This fitting procedure is already performed by way of example during the production of the hearing device, but this fitting may also preferably be performed by a hearing device acoustician or a comparable person skilled in the art at the point of sale or as the hearing device is adjusted to suit a wearer of the hearing device depending upon their request.

The hearing device according to an alternative variant of the invention likewise contains an electronic frame for holding electronic components. This electronic frame and also the electronic components correspond in this case essentially to the above-described type. Furthermore, the hearing device contains three resilient contacts (that are referred to below as first, second and third resilient contact) that are fastened (directly or by way of example indirectly by means of a contact carrier) to the electronic frame and are preferably electrically connected to at least one of the electronic components. These three resilient contacts are used—in accordance with this alternative embodiment in accordance with the invention—so as to electrically contact at least one of the electronic components with a rechargeable battery module that contains a rechargeable battery. Such a rechargeable battery module in this case contains a first connecting contact, a second connecting contact (referred to as the control contact) and a third connecting contact, which lies opposite the first connecting contact at a different (electrical) potential so as to contact the three resilient contacts. Moreover, the hearing device contains a battery carrier for holding a button cell so that it may move in relation to the contact carrier. This embodiment of the hearing device in accordance with the invention is therefore fundamentally initially configured for use with the rechargeable battery module as an energy source. However, in order by way of example during production of the hearing device to be able to configure the hearing device in a simple manner for operation with a hearing device battery (in particular the above-mentioned) button cell, the hearing device contains the above-described battery carrier. The above-described inventive idea—to also be able to use another energy source for a hearing device that is configured for operation with a specific energy source—is achieved by means of this embodiment in a manner that is similar but inverted with respect to the above-mentioned embodiments.

In addition to the rechargeable battery, the rechargeable battery module also contains the electronic convertor system similar to the above-mentioned embodiments. The rechargeable battery module preferably also contains the electronic charging system and also in particular the antenna for wireless charging of the rechargeable battery.

The three resilient contacts are arranged in a preferred embodiment on the above-mentioned contact carrier that is embodied separately from the electronic frame and is fastened to the electronic frame (in other words is configured in particular for the purpose of being fastened to the electronic frame when assembling the hearing device).

In one expedient embodiment, the hearing device is configured for the purpose of transmitting a control signal for activating or deactivating the electronic convertor system of the rechargeable battery module by the resilient contact (in particular the third) that is allocated to the second connecting contact (the control contact) of the rechargeable battery module.

In a further preferred embodiment, in the intended contacting state between the three resilient contacts and the double-pole battery (in particular the button cell) the (second and third) resilient contacts that are allocated respectively to the second connecting contact (in other words the control contact) and the third connecting contact of the rechargeable battery module lie respectively against a contact surface, the contact surface forming a pole of the button cell, in particular on an outer surface of the button cell. The resilient contact that is allocated to the first connecting contact of the rechargeable battery module lies in this state in particular on the further contact surface of the double-pole battery (specifically the button cell), in particular on an end face of the double-pole battery, the contact surface forming the corresponding other pole. In other words, in this embodiment when using a double-pole (in particular non-rechargeable) battery, specifically the button cell, the (third) resilient contact that is used to transmit the control signal to the rechargeable battery module also lies against the button cell and consequently contacts the button cell. This contacting arrangement of the resilient contact that is used to transmit the control signal and contains the second contact surface of the button cell (in addition to the second resilient contact) has turned out surprisingly to be non-critical with regard to malfunctions, a short circuit or the like. As a consequence, it is advantageously possible to reduce the constructive outlay for adapting the hearing device that is configured for operation with the rechargeable battery module for use with a battery.

It is preferred that within the scope of the above-described embodiment the second and the third resilient contact are embodied in such a manner that their contact sites (or: contact surfaces) lie in a common surface while the contact site of the first resilient contact lies accordingly in a surface that stands perpendicular with respect to the first resilient contact (in order to be able to bring said contact site into contact with the end face of the button cell).

In one expedient embodiment, the battery carrier is embodied in the shape of a battery compartment door. This is preferably held on the electronic frame or on the housing of the hearing device so as to be able to pivot. In order to "switch on" or activate the hearing device, the battery compartment door that carries the button cell in the intended operating state is therefore preferably moved (pivoted) into a closed position (in particular in the direction of the electronic frame) in such a manner that the first resilient contact contacts a contact surface of the button cell and the second and third resilient contacts simultaneously contact the other contact surface of the button cell. In order to switch off or deactivate the hearing device, the battery compartment door is consequently moved to such an extent that the respective contacting arrangements between the first, second and third resilient contacts and the respective contact surfaces are separated. In this case, as a consequence, the control signal that is transmitted via the third resilient contact so as to activate or deactivate the rechargeable battery module may also not be transmitted.

In an alternative embodiment that is also perceived as a separate invention, the battery carrier of the hearing device contains two contact springs for reversibly electrically contacting the respective contact surfaces of the button cell (said contact surfaces in particular being at a different potential) using the corresponding (in particular in relation to the electrical potential) resilient contacts. The two contact springs are consequently preferably used to provide the electrical contact between the contact surfaces of the button cell and the resilient contacts that are arranged on the electronic frame. The battery carrier in this case forms a type of interface or adaptor between a preferably conventional "hearing device battery" (in other words the button cell) and the resilient contacts of the hearing device, the resilient contacts being configured so as to contact the rechargeable battery module. The resilient contacts in this case lie in a common (in particular planar) plane so as to contact the rechargeable battery module in a simple manner, preferably using the contact surfaces of the resilient contacts.

Within the scope of this alternative embodiment, the battery carrier is also expediently configured for the purpose of preventing a contacting arrangement between the (third) resilient contact and the button cell, the third resilient contact being used to transmit the control signal or control command to the control contact. In particular, in the intended contacting state of the button cell, the third resilient contact is insulated by way of example by a wall of the battery carrier with respect to the button cell.

In a preferred embodiment, the battery carrier is also embodied in this case as a battery compartment door and the two contact springs are however integrated into the battery compartment door. It is preferred that the battery carrier in this case is connected in an articulated manner so as to be able to pivot on the electronic frame or on a housing of the hearing device.

In one expedient embodiment, the contact springs of the battery carrier are embodied according to a type of leaf spring. In particular, the two contact springs are arranged in the battery carrier in such a manner that one of the two contact springs touches a planar face of the button cell (that is preferably embodied as a button battery or button cell) and the other contact spring touches an outer surface that is at a different potential with respect to the above-mentioned planar face.

In a particularly expedient embodiment, in particular the contact spring of the battery carrier contains a helicoidal section, the contact spring touching the planar face of the button cell. This helicoidal section is embodied in this case in such a manner that it may compress in the thickness direction of the button cell. As a consequence, it is advantageously rendered possible to also use button cells that are of different thicknesses with the battery carrier, in particular the button cells may be inserted with their planar face (also referred to as end face) that lies opposite the helicoidal section in a flush manner with respect to the battery carrier.

In a further expedient embodiment, the battery carrier contains a base body and the contact springs are arranged on the base body and the base body (preferably in the intended state of use of the battery carrier) is connected in an immovable manner to the electronic frame, in particular fixedly (in other words preferably rigidly) connected to and contacted by the electronic frame, in particular the contact carrier. In this case, the battery carrier contains preferably in addition a flap that may pivot and is embodied in particular according to a type of a battery compartment door and in the intended inserted state of the button cell is reversibly held and the flap may reversibly pivot on to the contact springs that are arranged on the base body. In other words, the battery carrier in this embodiment contains a "dedicated" battery compartment door by which the inserted button cell may be contacted using the contact springs or removed from the contact springs so as to activate and deactivate the hearing device or the electronic components of the hearing device.

The kit in accordance with the invention contains the above-described hearing device that is configured by the three resilient contacts that are arranged on the electronic frame (optionally by means of the contact carrier) so as to contact the rechargeable battery module. Moreover, this kit contains the rechargeable battery module of the above-described type. In other words, the kit contains both the above-described battery carrier and also the rechargeable battery module that in particular contains the rechargeable battery, the electronic convertor system, the first connecting contact, the control contact and also the third connecting contact that correspond respectively to the resilient contacts (of the contact carrier). This rechargeable battery module in this case is preferably configured so as to be fixedly (preferably rigidly, in other words in particular immovably) installed in a housing of the hearing device. In this case, therefore preferably selectively either the rechargeable battery is fixedly mounted in the housing or is inserted into the battery compartment door that may pivot.

It is preferred that in the case of this rechargeable battery module (in particular for the case that the second and third resilient contact contact the button cell on the same contact surface) the contact sites that are allocated to the second and third connecting contact respectively lie in a common surface, in particular in an outer surface of the rechargeable battery module that is preferably embodied as approximately cylindrical. The contact site of the first connecting contact in this case preferably lies transversely with respect to the contact sites of the second and third connecting contact, in particular on an end face of the rechargeable battery module, the end face standing approximately at a right angle with respect to the outer surface.

Other features which are considered as characteristic for the invention are set forth in the appended claims.

Although the invention is illustrated and described herein as embodied in a hearing aid and a kit for a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
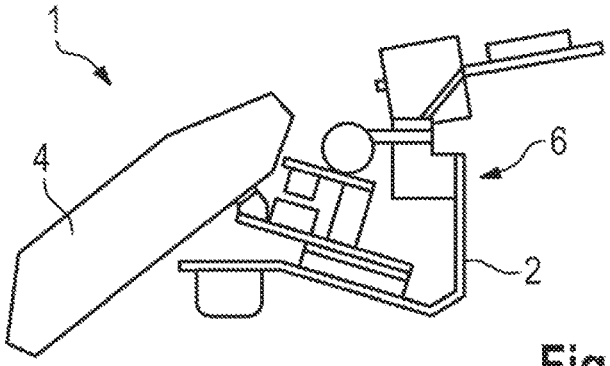
FIG. 1 is a diagrammatic, side view of an electronic frame of a hearing device.

Parts that correspond to one another are always provided with identical reference numerals in all the figures.

Figure 2:
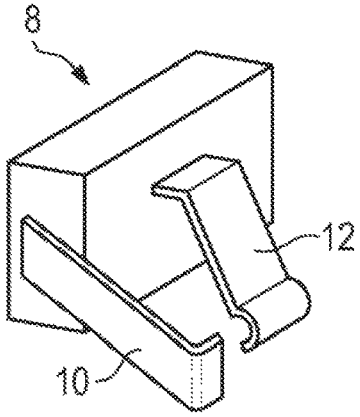
FIG. 2 is a perspective view a contact carrier that is connected in an intended assembled state to the electronic frame.

Referring now to the figures of the drawings in detail and first, particularly to FIG. 1 thereof, there is shown an electronic frame 1 of a hearing device that is not illustrated in more detail. The electronic frame 1 contains a base body 2 and multiple electronic components are provided on the base body, such as for example a microphone module 4, operating elements and electronic circuits that are used for the signal processing of the noises that are ascertained by the microphone module 4 (and consequently form a signal processor). The base body 2 is formed in the present exemplary embodiment by a circuit board that is formed in a three-dimensional manner. In this case, the base body 2 contains a connecting surface 6 and a contact carrier 8 that is illustrated in FIG. 2 is fastened to the connecting surface in the intended assembled state. In this case, the contact carrier 8 contains a first resilient contact 10 and a second resilient contact 12. These two resilient contacts 10 and 12 are connected via the connecting surface 6 to the electronic components in such a manner as to be able to transmit signals.

Figure 3:
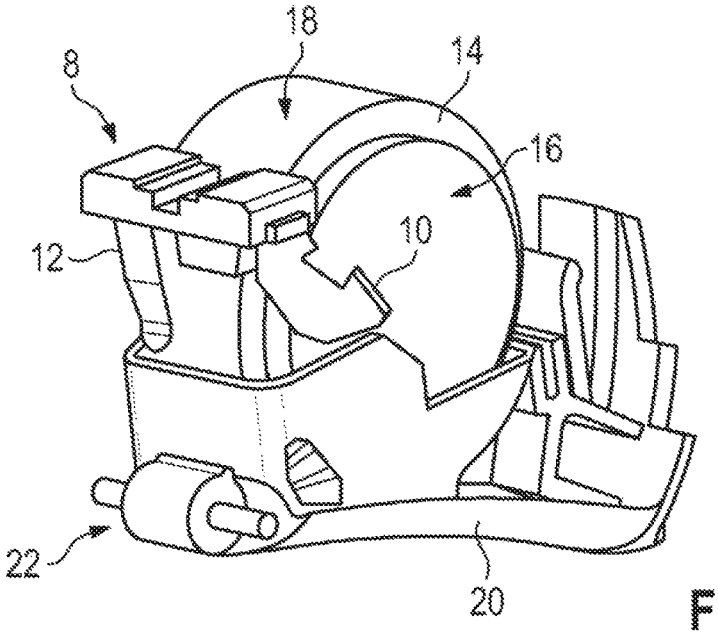
FIG. 3 is a perspective view of a section of a battery compartment door that is used as a battery carrier, the battery compartment door having a non-rechargeable battery inserted in an intended contacting state with the contact carrier.

As is apparent in FIG. 3, the two resilient contacts 10 and 12 are oriented on the contact carrier 8 in such a manner that in the intended contacting state the resilient contacts contact a double-pole, non-rechargeable battery, in this case in the form of a button cell 14, on contact surfaces 16 and 18 of the battery that are at a different electrical potential. In this case, the first resilient contact 10 touches the first contact surface 16 that is embodied on an end face of the button cell 14 and the second resilient contact 12 of the contact carrier 8 touches the second contact surface 18 that is formed by an outer surface of the button cell 14. The first contact surface 16 of the button cell 14 in this case is at ground potential. The button cell 14 is inserted in the intended contacting state into a battery compartment door 20 that forms a battery carrier and is held so as to be able to pivot by a hinge 22 on a housing of the hearing device (not illustrated) and is pivoted in the direction of the electronic frame 1 or the contact carrier 8.

Figure 4:
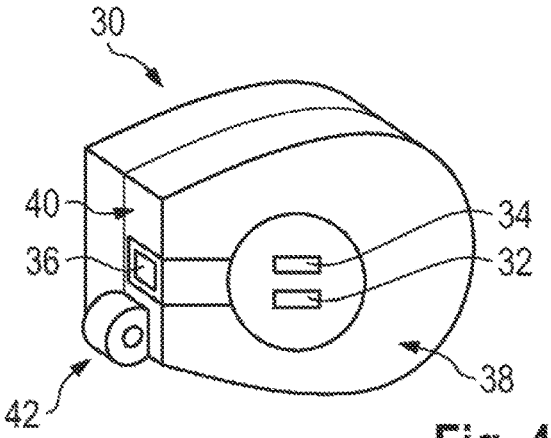
FIG. 4 is a perspective plan view of a rechargeable battery module that is configured so as to contact the contact carrier according to FIG. 2.

In order to also be able to operate the above-described hearing device with a rechargeable battery, within the scope of a kit that is used so as to selectively embody the hearing device for operation with the button cell 14 or with a rechargeable battery the hearing device contains a rechargeable battery module 30, the rechargeable battery module being illustrated in FIG. 4 and being in addition to the battery compartment door 20 and being able to be held selectively on the housing of the hearing device so as to be able to pivot. The rechargeable battery module 30 represents a unit that in addition to the rechargeable battery contains an electronic charging system and also an electronic convertor system for adjusting the output voltage value that is output by the rechargeable battery to an operating voltage value that is required to operate the electronic components of the hearing device. Furthermore, the rechargeable battery module 30 contains a first connecting contact 32, a second connecting contact, which is referred to below as a control contact 34, and a third connecting contact 36. The first and the third connecting contact 32 and 36, respectively, are in this case at different electrical potentials. Specifically, the first connecting contact 32 is at ground potential. The control contact 34 is used for the purpose of activating the electronic convertor system of the rechargeable battery module 30 by means of interconnection (specifically: short circuit) with the first connecting contact 32. The first connecting contact 32 and the control contact 34 are in this case arranged adjacent to one another on a planar face or end face 38 of the rechargeable battery module 30 in such a manner that the connecting contact and control contact are contacted and consequently short circuited in the intended contacting state between the rechargeable battery module 30 and the contact carrier 8 by the first resilient contact 10 of the contact carrier 8. The third connecting contact 36 is embodied on an outer face 40 of the rechargeable battery module 30 with the result that the contact surface that is formed by the third connecting contact 36 is oriented transversely with respect to the plane of the contact surfaces of the two connecting contacts 32 and 34. The third connecting contact 36 is contacted in this case in the intended contacting state by the second resilient contact 12 of the contact carrier 8. Moreover, the rechargeable battery module 30 also contains a hinge 42 and in the intended assembled state of the hearing device the rechargeable battery module 30 is connected by means of the hinge in an articulated manner so as to be able to pivot on the housing of the hearing device in a manner comparable to the battery compartment door 20.

Figure 5:
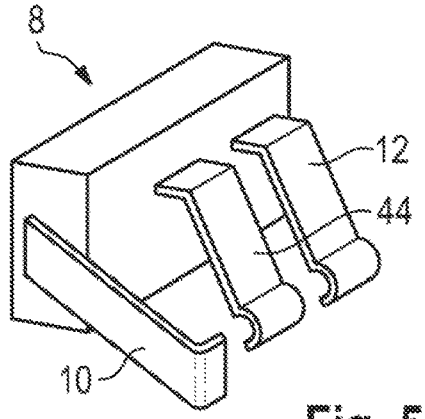
FIG. 5 is a perspective view in accordance with FIG. 2 of an alternative exemplary embodiment of the contact carrier.
Figure 6:
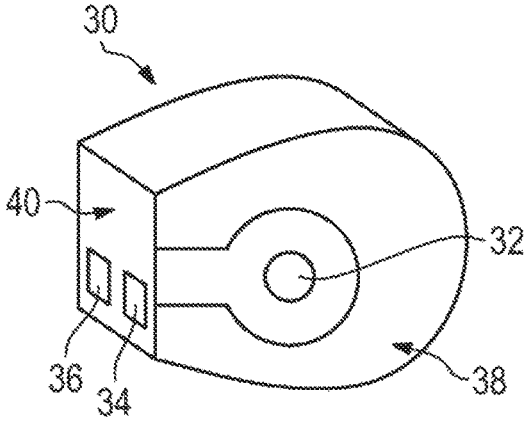
FIG. 6 is a perspective view in accordance with FIG. 4 of an alternative exemplary embodiment of the rechargeable battery module for contacting the contact carrier according to FIG. 5.

An alternative exemplary embodiment of the contact carrier 8 is illustrated in FIG. 5. In this case, the contact carrier 8 contains a third resilient contact 44 in addition to the first resilient contact 10 and the second resilient contact 12. In this case, this third resilient contact 44 is used so as to directly contact the control contact 34 of the rechargeable battery module 30. The rechargeable battery module 30 that corresponds to this contact carrier 8 is illustrated in FIG. 6. In this case, "only" the first connecting contact 32 is arranged on the planar face 38 of the rechargeable battery module 30. In this case, the control contact 34 and the third connecting contact 36 are both positioned (adjacent to one another) on the outer surface 40 of the rechargeable battery module 30. Within the scope of the exemplary embodiment that is described with reference to FIGS. 5 and 6, the hearing device is configured for the purpose of deactivating the rechargeable battery module 30, specifically its electronic convertor system, by means of a control signal that is transmitted via the third resilient contact 44. Consequently, it is not necessary to remove the rechargeable battery module 30 from the resilient contacts 10, 12 and 44 in order to deactivate the rechargeable battery module 30 and to switch off the hearing device. This exemplary embodiment is also considered to be a separate invention.

This hearing device (likewise as described above, and also within the scope of a kit in addition to the rechargeable battery module 30 according to FIG. 6) contains the battery compartment door 20 in accordance with FIG. 3 so as to operate the hearing device that contains the contact carrier 8 in accordance with FIG. 5 using the button cell 14. In order to "switch on" or activate the hearing device, the battery compartment door 20 that carries the button cell 14 is pivoted in the direction of the electronic frame 1 (into a closed position) with the result that the first resilient contact 10, the first contact surface 16 that is arranged on the end face of the button cell 14 and the second and third resilient contacts 12 and 44 of the contact carrier 8 both contact the outer side second contact surface 18 of the button cell 14. In order to switch off or deactivate the hearing device, the battery compartment door 20 is pivoted out with the result that the respective contacts of the first, second and third resilient contacts 10, 12 and 44 having the respective contact surfaces 16 and 18 are separated.

Figure 7:
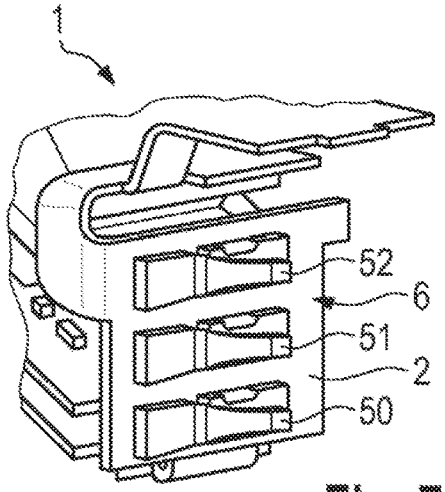
FIG. 7 is a perspective view of a section the electronic frame of an alternative exemplary embodiment having three contacts for contacting a rechargeable battery module.

A further alternative exemplary embodiment of the hearing device is illustrated in FIG. 7. In this case, three resilient contacts (referred to as the first resilient contact 50, second resilient contact 51 and third resilient contact 52) are arranged on the electronic frame 1 of the hearing device, specifically on the connecting surface 6 of the hearing device and are electrically connected to the electronic components of the hearing device. In this case, these three resilient contacts 50, 51 and 52 are used in order to contact the first connecting contact 32 of the control contact 34 and the third connecting contact 36 of the rechargeable battery module 30, the connecting contacts in this case being arranged adjacent to one another on the outer surface 40 of the rechargeable battery module 30 (see FIG. 8). The contact sites of the resilient contacts 50, 51 and 52, the contact sites being allocated to the connecting contacts 32, 34 and 36, in other words the contact surfaces that are arranged on the free ends of the resilient contacts 50, 51 and 52 are in this case arranged in a "contact plane" that is approximately parallel to the connecting surface 6.

Figure 8:
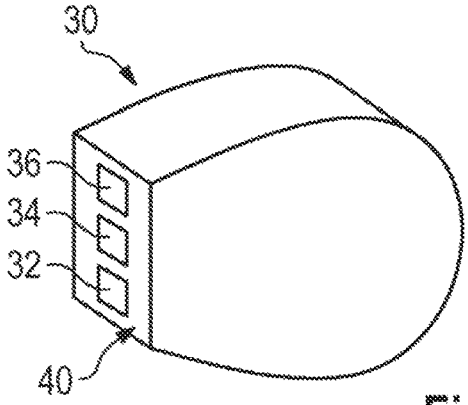
FIG. 8 is a perspective view in accordance with FIG. 4 of an alternative exemplary embodiment of the rechargeable battery module for contacting the contacts in accordance with FIG. 7.
Figure 9:
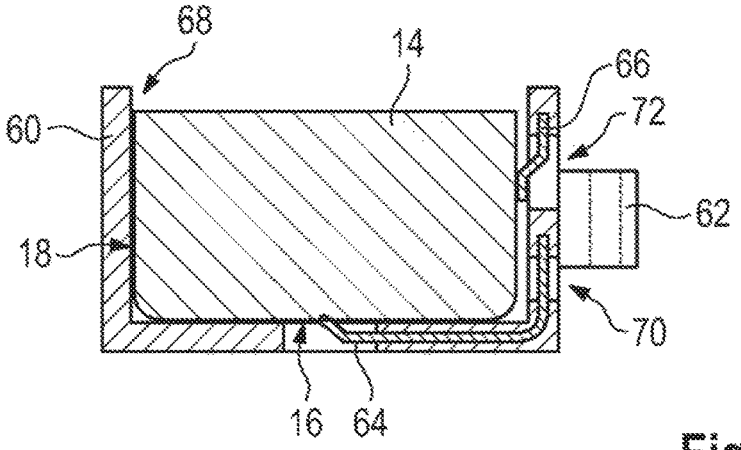
FIGS. 9-11 are cross sectional view of an alternative exemplary embodiment of a battery carrier for contacting the battery using the contacts according to FIG. 7.
Figure 10:
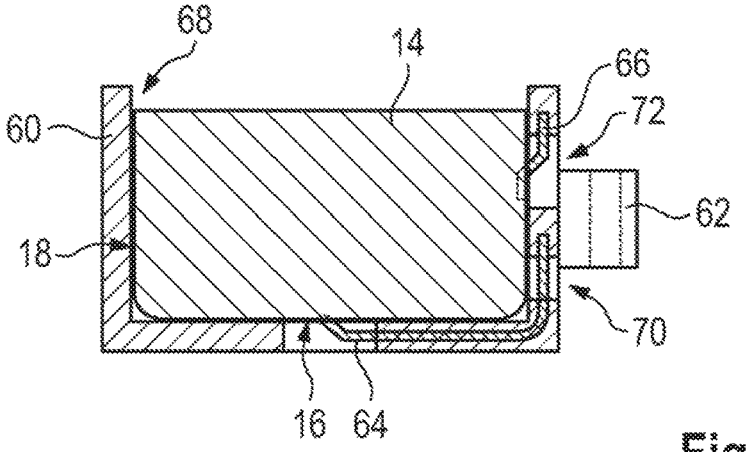
Figure 11:
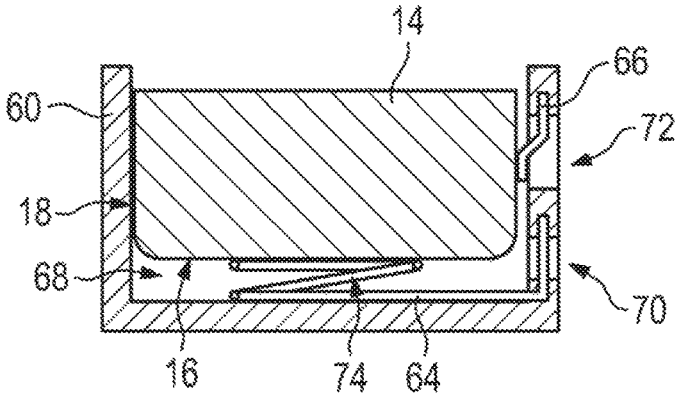

In order to also be able to operate the hearing device that is described within the scope of FIG. 7 using the button cell 14, within the scope of a kit that serves so as to selectively embody the hearing device for operation using the rechargeable battery module 30 according to FIG. 8 or using the button cell 14, the hearing device contains a battery carrier that is embodied as a battery compartment door 60 in accordance with any one of the FIGS. 9, 10 and 11. In this case, the battery compartment door 60 contains a hinge 62 and the battery compartment door 60 having where appropriate an inserted button cell 14 may be pivoted by means of the hinge from an open position ("off setting") in the direction of the resilient contacts 50, 51 and 52 of the electronic frame 1. Furthermore, the battery compartment door 60 contains a first contact spring 64 and a second contact spring 66 that protrude into an inner chamber 68 of the battery compartment door 60 into which the button cell 14 is inserted in the intended inserted state (see FIGS. 9, 10 and 11).

In this case, the first contact spring 64 is arranged in such a manner that it contacts the first contact surface 16 of the button cell 14 in the intended inserted state. The second contact spring 66 is positioned in the battery compartment door 60 in such a manner that the contact spring touches the second contact surface 18, in other words the outer surface of the button cell 14. In this case, the two contact springs 64 and 66 lie respectively in a recess 70 and 72 of a side wall of the battery compartment door 60 open toward the outer face with the result that as the battery compartment door 60 is pivoted inward in the direction of the electronic frame 1, the resilient contacts 50 and 52 of the electronic frame 1 that are allocated to the respective potential of the two contact surfaces 16 and 18 of the button cell 14 come into electrical contact with the open section of the contact springs 64 or 66 that lies in the respective recess 70 or 72. The resilient contact 51 that corresponds to the control contact 34 of the rechargeable battery module 30 is prevented in this case from contacting the second contact surface 18 of the button cell 14 by (the side wall) of the battery compartment door 60.

FIG. 10 illustrates an exemplary embodiment of the battery compartment door 60 in which the battery compartment door 60 is enlarged in the thickness direction of the button cell 14. As a consequence, a "thicker" button cell 14 in comparison to FIG. 9 may be held in the battery compartment door 60 and may be used with the hearing device in accordance with FIG. 7.

An alternative exemplary embodiment of the battery compartment door 60 is illustrated in FIG. 11. The battery compartment door 60 of this exemplary embodiment is configured for the purpose of being able to receive and to contact button cells 14 that are of different thicknesses. For this purpose, the first contact spring 64 contains a helicoidal section 74 and in the intended inserted state the button cell 14 sits with its first contact surface 16 on the helicoidal section. In the event that a thicker button cell 14 than the illustrated button cell 14 is inserted into the battery compartment door 60, specifically into the inner chamber 68 of the battery compartment door, the helicoidal section 74 of the first contact spring 64 compresses. The covering surface of the button cell 14 that lies opposite the first contact surface 16 may consequently always be held flush with the battery compartment door 60, specifically may be held flush with the open end of the inner chamber 68 in the battery compartment door 60.

Figure 12:
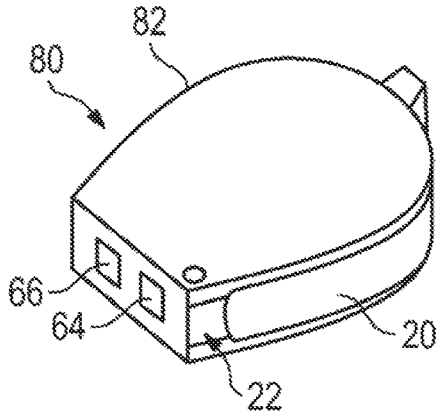
FIG. 12 is a perspective view of the alternative exemplary embodiment of the battery carrier for contacting the battery using the contacts according to FIG. 7.

FIG. 12 illustrates a further alternative exemplary embodiment of the battery carrier for the hearing device according to FIG. 7. In this case, the battery carrier is embodied as a battery module 80 that contains a housing-shaped base body 82. The two contact springs 64 and 66 are arranged on the base body 82. Furthermore, the battery module 80 contains a flap that essentially corresponds to the battery compartment door 20 in accordance with FIG. 3. In this case, the battery compartment door 20 is connected in an articulated manner by its hinge 22 so that the battery compartment door may pivot on the base body 82. The battery carrier that is formed by means of the battery module 80 is configured in this exemplary embodiment for the purpose of always being contacted in the intended installed state in the hearing device by the contact springs 64 and 66 using the resilient contacts 50 and 52. In this case, the contact springs 64 and 66 in the interior of the base body 82 are embodied in a comparable manner to the resilient contacts 10 and 12 in accordance with FIG. 2 with the result that as the battery compartment door 20 is pivoted out of the base body 82, the button cell 14 that is inserted into the battery compartment door 20 is removed from the contact springs 64 and 66 and the hearing device is therefore switched off.

Figure 13:
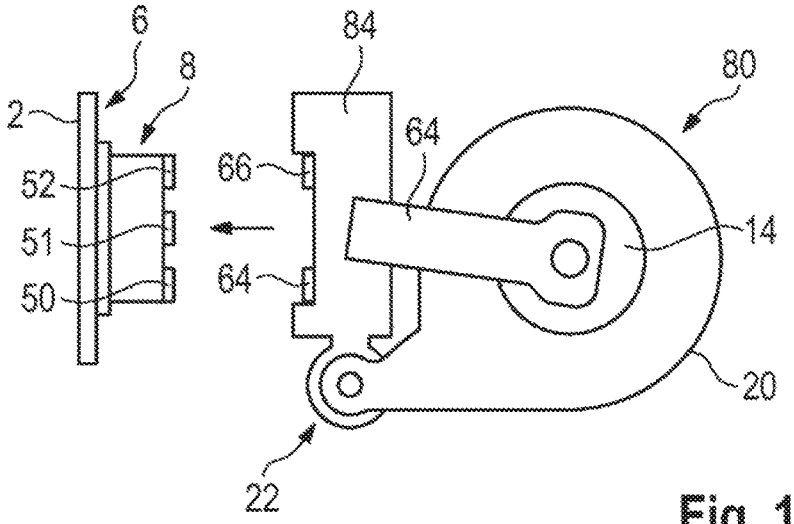
FIG. 13 is a side view of the alternative exemplary embodiment of the battery carrier for contacting the battery using the contacts according to FIG. 7.

In an alternative exemplary embodiment that is illustrated in FIG. 13, the three resilient contacts 50, 51 and 52 are held together on the contact carrier 8 that is described above with regard to FIG. 2 and are arranged by means of the contact carrier on the connecting surface 6 of the electronic frame 1. The battery carrier is in this case embodied in a comparable manner to the exemplary embodiment in accordance with FIG. 12 as a two-part battery module 80. In this case, the battery carrier contains a plug body 84, which is used to mechanically fix the battery carrier to the contact carrier 8, and also the battery compartment door 20 that is connected in an articulated manner by the hinge 22 so that the battery compartment door may pivot on the plug body 84. The contact springs 64 and 66 are arranged on the plug body 84 and are consequently fixed with respect to the battery compartment door 20 in the intended assembled state. Moreover, the contact carrier 8 is configured in this exemplary embodiment for the purpose of holding the plug body 44 by means of traction. Furthermore, the battery compartment door 20 is mounted so as to be able to pivot on the plug body 84 in such a manner that as the battery compartment door 20 is pivoted in the direction of the plug body 84 the contact springs 64 and 66 contact the button cell 14.

Figure 14:
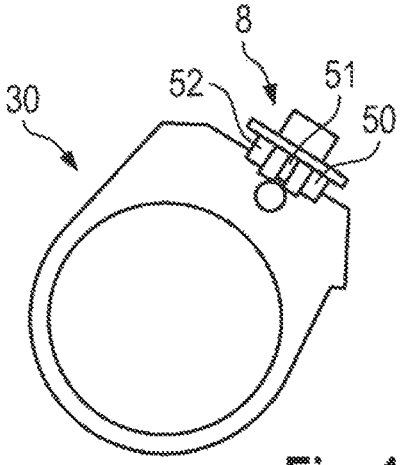
FIG. 14 is a plan view of a further exemplary embodiment of the rechargeable battery module in accordance with FIG. 8 in a contacted state with the contacts in accordance with FIG. 7.

FIG. 14 illustrates the contacting arrangement of the rechargeable battery module 30 using the resilient contacts 50, 51 and 52 of the contact carrier 8 described immediately above.

Figure 15:
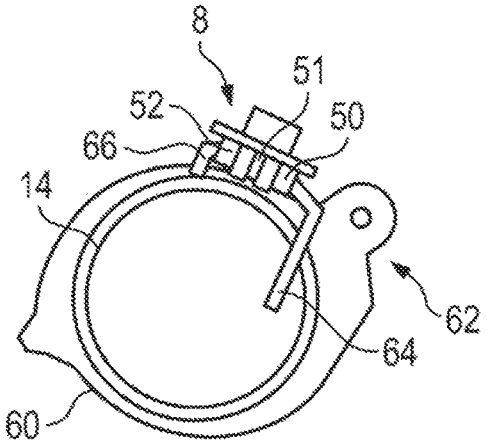
FIG. 15 is a plan view in accordance with FIG. 14 of a still further exemplary embodiment of the battery carrier in accordance with FIG. 9 in the contacted state with the contacts in accordance with FIG. 14.

FIG. 15 illustrates a further exemplary embodiment of the battery carrier described within the scope of FIG. 9 in the form of the battery compartment door 60 and also the resilient contacts 50, 51 and 52. The resilient contacts 50, 51 and 52 in this case are arranged in a comparable manner to the exemplary embodiment in accordance with FIG. 13 on the contact carrier 8. The battery compartment door 60 is connected (in a manner that is not further illustrated) in an articulated manner so that the battery compartment door may pivot on the electronic frame 1 or on the housing of the hearing device. Specifically, the battery compartment door 60 is in the intended contacting state with the resilient contacts 50, 51 and 52.

The subject matter of the invention is not limited to the exemplary embodiments described above. On the contrary, further embodiments of the invention may be derived from the above description by the person skilled in the art. In particular, the individual features of the invention that are described with reference to the various exemplary embodiments and their embodiment variants may also be combined with one another in other ways.

The following is a summary list of reference numerals and the corresponding structure used in the above description of the invention:

1 Electronic frame
2 Base body
4 Microphone module
6 Connecting surface
8 Contact carrier
10 First resilient contact
12 Second resilient contact
14 Button cell
16 Contact surface
18 Contact surface
20 Battery compartment door
30 Rechargeable battery module
32 First connecting contact
34 Control contact
36 Connecting contact
38 End face
40 Outer face
42 Hinge
44 Third resilient contact
50 Resilient contact
51 Resilient contact
52 Resilient contact
60 Battery compartment door
64 First contact spring
66 Second contact spring
68 Inner chamber
70 Recess
72 Recess
74 Helicoidal section
80 Battery module
82 Base body
84 Plug body

The invention claimed is:

1. A hearing device, comprising:

electronic components;

an electronic frame for holding said electronic components;

a rechargeable battery module for a rechargeable battery having a first connecting contact, a second connecting contact and a third connecting contact, lying opposite said first connecting contact at a different potential;

three resilient contacts fastened to said electronic frame, said three resilient contacts used so as to electrically contact at least one of said electronic components using said first connecting contact, said second connecting contact and said third connecting contact of said rechargeable battery module;

a battery carrier holding a double-pole battery so that said battery carrier holding said double-pole battery may move in relation to said three resilient contacts, said double-pole battery having a first contact surface and a second contact surface; and in an intended contacting state between said three resilient contacts and said double-pole battery said resilient contacts allocated respectively to said second connecting contact and said third connecting contact of said rechargeable battery module lie respectively against said first contact surface of said double-pole battery, said first contact surface forming a first pole, and one of said resilient contacts that is allocated to said first connecting contact lies against said second contact surface of said double-pole battery, said second contact surface forming a corresponding second pole.

2. The hearing device according to claim 1, further comprising a contact carrier carrying said three resilient contacts and is fastened to said electronic frame.

3. The hearing device according to claim 1, wherein one of said resilient contacts that is allocated to said second connecting contact is used so as to transmit a control signal to said rechargeable battery module.

4. The hearing device according to claim 1, further comprising a housing; and wherein said battery carrier is embodied as a battery compartment door for reversibly holding said double-pole battery, and said battery compartment door is connected in an articulated manner so as to be able to pivot on said electronic frame or on said housing of the hearing device in such a manner that as said battery compartment door is pivoted into a closed position said first contact surface and said second contact surface of said double-pole battery are contacted using respective corresponding ones of said resilient contacts.

5. The hearing device according to claim 1, wherein said battery carrier contains two contact springs for reversibly electrically contacting said first contact surface and said second contact surface of said double-pole battery using corresponding ones of said resilient contacts.

6. The hearing device according to claim 5, wherein said battery carrier is embodied as a battery compartment door and said two contact springs are integrated into said battery compartment door.

7. The hearing device according to claim 6, wherein one of said contact springs of said battery carrier has a helicoidal section that lies against an end face of said double-pole battery in the intended inserted state of said double-pole battery.

8. The hearing device according to claim 7, wherein:

said battery carrier has a base body and said contact springs are disposed on said base body and said base body is fixedly connected to and contacted by said electronic frame; and said battery carrier has a flap that may pivot and in the intended inserted state said two-pole battery is reversibly held in said flap and said flap may reversibly pivot on to said contact springs of said base body.

9. A hearing device, comprising:

electronic components;

an electronic frame for holding said electronic components;

two resilient contacts including a first resilient contact and a second resilient contact, said two resilient contacts are fastened to said electronic frame, said resilient contacts are configured so as to reversibly electrically contact at least one of said electronic components using contact surfaces of a double-pole battery; and a rechargeable battery module having a rechargeable battery and an electronic convertor system and that is connected in an articulated manner to said electronic frame so as to be able to move and having connecting contacts that correspond to said two resilient contacts, wherein said rechargeable battery module containing three of said connecting contacts including a first connecting contact and a second connecting contact spaced with respect to one another in such a manner that said first and second connecting contacts are contacted in an intended contacting state of said rechargeable battery module by a first of said resilient contacts.

10. The hearing device according to claim 9, wherein:

said first connecting contact and said second connecting contact contain allocated contact sites that lie in a common plane; and a third connecting contact of said three connecting contacts is oriented with a contact site transversely with respect to said contact sites of said first and second connecting contact.

11. The hearing device according to claim 9, further comprising a housing; and wherein said rechargeable battery module is connected in an articulated manner so as to be able to move on said electronic frame or on said housing of the hearing device.

* * * * *